US010198996B2

(12) United States Patent
Yoon et al.

(10) Patent No.: US 10,198,996 B2
(45) Date of Patent: Feb. 5, 2019

(54) ORGANIC LIGHT EMITTING DIODE DISPLAY DEVICE AND METHOD FOR DRIVING THE SAME

(71) Applicant: LG Display Co., Ltd., Seoul (KR)

(72) Inventors: Sanghun Yoon, Seoul (KR); ChangHeon Kang, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 15/797,281

(22) Filed: Oct. 30, 2017

(65) Prior Publication Data

US 2018/0122301 A1 May 3, 2018

(30) Foreign Application Priority Data

Oct. 31, 2016 (KR) ..... 10-2016-0143409

(51) Int. Cl.
*G09G 3/3258* (2016.01)

(52) U.S. Cl.
CPC ..... *G09G 3/3258* (2013.01); *G09G 2300/043* (2013.01); *G09G 2300/0426* (2013.01); *G09G 2300/0814* (2013.01); *G09G 2310/0262* (2013.01)

(58) Field of Classification Search
CPC ..... G09G 3/3258; G09G 2300/0426; G09G 2300/0814; G09G 2300/043; G09G 2310/0262
See application file for complete search history.

(56) References Cited

U.S. PATENT DOCUMENTS 8,284,134 B2 * 10/2012 Park ..... G09G 3/3233 345/76
8,614,652 B2 * 12/2013 Nathan ..... G09G 3/3233 345/55
9,978,310 B2 * 5/2018 Chaji ..... G09G 3/3291
2005/0083270 A1 * 4/2005 Miyazawa ..... G09G 3/3233 345/76
2005/0275352 A1 * 12/2005 Sun ..... G09G 3/3233 315/169.3
2006/0221009 A1 * 10/2006 Miwa ..... G09G 3/325 345/76
2007/0109232 A1 * 5/2007 Yamamoto ..... G09G 3/3233 345/77
2013/0141316 A1 6/2013 Lee et al.
2014/0184665 A1 7/2014 Yoon et al.
(Continued)

FOREIGN PATENT DOCUMENTS

KR 10-2011-0122410 A 11/2011
KR 10-2013-0062573 A 6/2013
(Continued)

OTHER PUBLICATIONS

Office Action dated Dec. 16, 2017, issued in corresponding Korean Patent Application No. 10-2016-0143409.

*Primary Examiner* — Christopher E Leiby
(74) *Attorney, Agent, or Firm* — Morgan, Lewis & Bockius LLP

(57) ABSTRACT

An organic light emitting diode display device and a method for driving the same are provided. The organic light emitting diode display device includes an organic light emitting diode disposed on each of a plurality of pixels, and a pixel driving circuit configured to drive the organic light emitting diode.

10 Claims, 8 Drawing Sheets

(56) References Cited

U.S. PATENT DOCUMENTS

| | | | | |
|---|---|---|---|---|
| 2014/0204067 | A1* | 7/2014 | Gupta | G09G 3/3233 345/211 |
| 2014/0300281 | A1* | 10/2014 | Chaji | G09G 3/3233 315/161 |
| 2014/0326969 | A1 | 11/2014 | Kim | |
| 2016/0189622 | A1* | 6/2016 | Lee | G09G 3/3233 345/212 |

FOREIGN PATENT DOCUMENTS

| | | | |
|---|---|---|---|
| KR | 10-2014-0086466 | A | 7/2014 |
| KR | 10-2014-0086467 | A | 7/2014 |
| KR | 201-2014-0131637 | A | 11/2014 |

* cited by examiner

ORGANIC LIGHT EMITTING DIODE DISPLAY DEVICE AND METHOD FOR DRIVING THE SAME

CROSS-REFERENCE TO RELATED APPLICATIONS

This application claims the priority of Korean Patent Application No. 10-2016-0143409 filed on Oct. 31, 2016, in the Korean Intellectual Property Office, the disclosure of which is incorporated herein by reference.

BACKGROUND

Technical Field

The present disclosure relates to an organic light emitting diode display device and a method for driving the same and more particularly, to an organic light emitting diode display device which can be driven at a high frequency and a method for driving the same.

Description of the Related Art

A flat panel display (FPD) has been applied to various electronic devices such as mobile phone, tablet PC, notebook, television, and monitor. Examples of the recent FPD may include a liquid crystal display device (hereinafter, referred to as "LCD"), an organic light emitting diode display (hereinafter, referred to as "OLED"), and the like. The display device includes a plurality of pixels, and includes a pixel array configured to display an image and including a plurality of pixels and a driving circuit configured to control each of the plurality of pixels to transmit light or emit light. The driving circuit of the display device includes a data driving circuit configured to supply a data signal to data lines on the pixel array. Also, the driving circuit includes a gate driving circuit (or scan driving circuit) configured to sequentially supply a gate signal (or scan signal) to be synchronized with the data signal to gate lines (or scan lines) on the pixel array. Further, the driving circuit includes a timing controller configured to control the data driving circuit and the gate driving circuit.

Each of a plurality of pixels constituting the OLED includes an organic light emitting diode including an organic emission layer between an anode and a cathode and a pixel driving circuit that independently drives the organic light emitting diode. The pixel driving circuit includes a switching thin film transistor (hereinafter, referred to as "TFT"), a driving TFT, and a capacitor. Herein, the switching TFT charges the capacitor with a data voltage in response to a scan pulse. Also, the driving TFT controls the amount of current to be supplied to the organic light emitting diode depending on the data voltage charged in the capacitor and thus controls the amount of light emission of the organic light emitting diode.

Particularly, the OLED is a self-light emitting display device. The OLED does not need a separate light source unlike the LCD. Thus, the OLED can be manufactured into a lightweight and thin form. Further, the OLED is advantageous in terms of power consumption since it is driven with a low voltage. Also, the OLED has excellent color expression ability, a high response speed, a wide viewing angle, and a high contrast ratio (CR). Therefore, the OLED has been researched as a next-generation display device in many fields. In addition, the organic light emitting diode has a surface emitting structure and thus can be easily implemented into a flexible form.

In the OLED having the above-described advantages, the pixel driving circuits are different from each other in a threshold voltage (Vth) and mobility of the driving TFT due to a process variation or the like. Also, a voltage drop of a high-potential voltage (VDD) may cause a change in the amount of current for driving the organic light emitting diode. Therefore, there is a luminance difference between the plurality of pixels. Thus, many attempts to improve an image quality by introducing a compensation circuit that compensates a characteristic difference of a driving TFT and a voltage drop of a high-potential voltage VDD in a pixel driving circuit and thus reduces a luminance difference between pixels are being made.

A pixel driving circuit including the compensation circuit includes a plurality of switching TFTs and capacitors. Further, the pixel driving circuit controls the plurality of switching TFTs by different signals, respectively, to compensate a characteristic difference of a driving TFT. Furthermore, an operation of the pixel driving circuit is changed depending on the timing of the signals controlling the switching TFTs.

Thus, as the switching TFT and capacitors constituting the pixel driving circuit are increased and the signals controlling the pixel driving circuit are increased, more time is required for each pixel to emit light. That is, as the pixel driving circuit becomes complicated, the time required for controlling emission from each of the plurality of pixels is increased and a 1 horizontal period 1 H which is the time required for controlling emission from each horizontal line in the OLED is increased.

In the OLED, as the 1 horizontal period is increased, the number of horizontal lines which can be controlled during 1 frame may be decreased and there may be a problem with the implementation of high-resolution screen.

Accordingly, an organic light emitting diode display device capable of reducing an increase in a 1 horizontal period and the difficulty in driving with a high resolution as the pixel driving circuit becomes complicated and a method for driving the same are needed.

RELATED ART DOCUMENT

1. Organic light emitting diode display device and method for driving the same (Korean Patent Laid-open Publication No. 10-2014-0086467)

SUMMARY

Accordingly, embodiments of the present disclosure are directed to an organic light emitting diode display device and a method for driving the same that substantially obviates one or more of the problems due to limitations and disadvantages of the related art.

An aspect of the present disclosure is to provide an organic light emitting diode display device capable of remarkably reducing a 1 horizontal period by simultaneously performing sampling and programming during the 1 horizontal period and a method for driving the same.

Another aspect of the present disclosure is to provide an organic light emitting diode display device which can be driven with a higher resolution than an organic light emitting diode display device driven at the same driving frequency by reducing a 1 horizontal period and a method for driving the same.

Additional features and aspects will be set forth in the description that follows, and in part will be apparent from the description, or may be learned by practice of the inventive concepts provided herein. Other features and aspects of the inventive concepts may be realized and attained by the structure particularly pointed out in the written description, or derivable therefrom, and the claims hereof as well as the appended drawings.

To achieve these and other aspects of the inventive concepts, as embodied and broadly described, an organic light emitting diode display device comprises an organic light emitting diode disposed on each of a plurality of pixels, and a pixel driving circuit configured to drive the organic light emitting diode. The pixel driving circuit includes a driving switching element electrically connected to the organic light emitting diode and electrically connected between a high-potential voltage supply line and a low-potential voltage supply line. Further, the pixel driving circuit includes a first switching element connected to a gate of the driving switching element and a first scan signal line. Furthermore, the pixel driving circuit includes a second switching element connected to a drain of the driving switching element and a first emission control signal line. Moreover, the pixel driving circuit includes a first capacitor connected between the gate of the driving switching element and a first node. Further, the pixel driving circuit includes a third switching element connected to a source of the driving switching element, a second scan signal line, and an initialization voltage line. Furthermore, the pixel driving circuit includes a fourth switching element connected to the first node and a second emission control signal line. Moreover, the pixel driving circuit includes a fifth switching element connected to the first node, a third scan signal line, and a data voltage line. Further, the pixel driving circuit includes a second capacitor connected between the gate of the driving switching element and the source of the driving switching element. In the organic light emitting diode display device according to an exemplary embodiment of the present disclosure, it is possible to remarkably reduce a 1 horizontal period by simultaneously performing sampling and programming during the 1 horizontal period.

In another aspect, a method for driving an organic light emitting diode display device is provided. The organic light emitting diode display device includes an organic light emitting diode disposed on each of a plurality of pixels, and a pixel driving circuit configured to drive the organic light emitting diode. The pixel driving circuit includes a driving switching element electrically connected to the organic light emitting diode and electrically connected between a high-potential voltage supply line and a low-potential voltage supply line. Further, the pixel driving circuit includes a first switching element connected to a gate of the driving switching element and a first scan signal line. Furthermore, the pixel driving circuit includes a second switching element connected to a drain of the driving switching element and a first emission control signal line. Moreover, the pixel driving circuit includes a first capacitor connected between the gate of the driving switching element and a first node. Further, the pixel driving circuit includes a third switching element connected to a source of the driving switching element, a second scan signal line, and an initialization voltage line. Furthermore, the pixel driving circuit includes a fourth switching element connected to the first node and a second emission control signal line. Moreover, the pixel driving circuit includes a fifth switching element connected to the first node, a third scan signal line, and a data voltage line. Further, the pixel driving circuit includes a second capacitor connected between the gate of the driving switching element and the source of the driving switching element. The method for driving the organic light emitting diode display device includes initializing a voltage in the source of the driving switching element by turning on the third switching element. Further, the method for driving the organic light emitting diode display device includes sampling the voltage in the source of the driving switching element by turning on the second switching element. Furthermore, the method for driving the organic light emitting diode display device includes writing and programming a data voltage on the first node by turning on the fifth switching element. Moreover, the method for driving the organic light emitting diode display device includes writing and coupling a reference voltage on the first node by turning on the fourth switching element. Further, the method for driving the organic light emitting diode display device includes making the organic light emitting diode emit light by turning on all the second switching element and the driving switching element. In the method for driving the organic light emitting diode display device according to another exemplary embodiment of the present disclosure, if the organic light emitting diode display device is driven at the same driving frequency, it can be driven with a higher resolution by reducing a 1 horizontal period.

Details of other exemplary embodiments will be included in the detailed description of the disclosure and the accompanying drawings.

According to the present disclosure, it is possible to manufacture an organic light emitting diode display device in which a data voltage line and a reference voltage line are separately connected to a pixel driving circuit. Thus, sampling and programming can be simultaneously performed during a 1 horizontal period.

Further, according to the present disclosure, it is possible to manufacture an organic light emitting diode display device in which a 1 horizontal period is reduced by simultaneously performing sampling and programming during the 1 horizontal period. Thus, the organic light emitting diode display device can be driven with a high resolution.

It is to be understood that both the foregoing general description and the following detailed description are exemplary and explanatory and are intended to provide further explanation of the inventive concepts as claimed.

BRIEF DESCRIPTION OF THE DRAWINGS

The accompanying drawings, which are included to provide a further understanding of the disclosure and are incorporated and constitute a part of this application, illustrate embodiments of the disclosure and together with the description serve to explain various principles. In the drawings.

DETAILED DESCRIPTION

Figure 1:
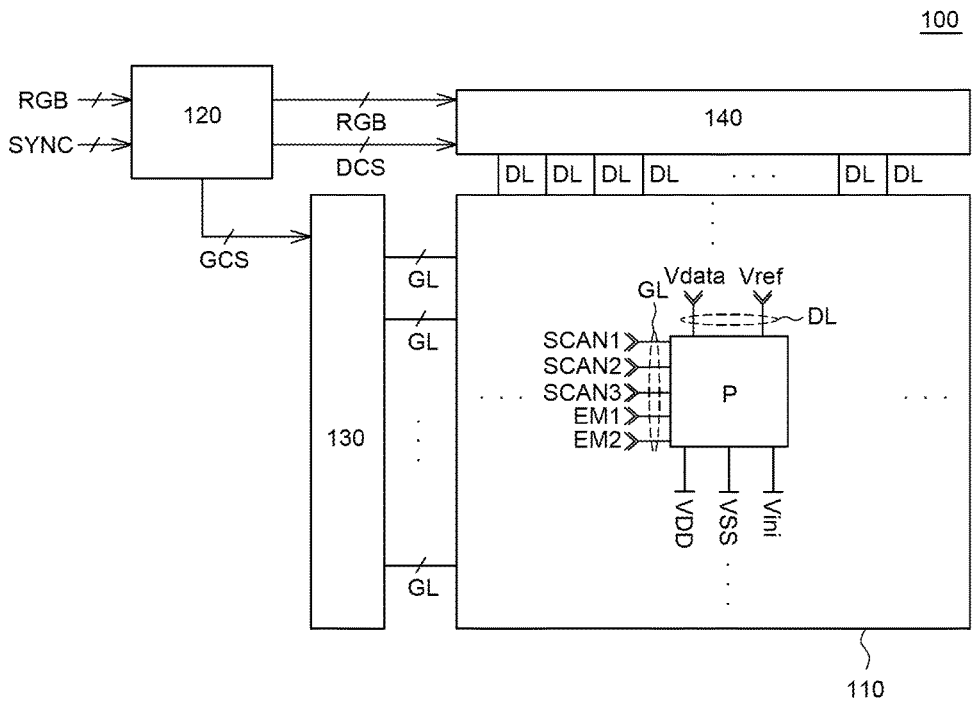
FIG. 1 is a schematic block diagram provided to explain an organic light emitting diode display device according to an exemplary embodiment of the present disclosure.

Advantages and features of the present disclosure, and methods for accomplishing the same will be more clearly understood from exemplary embodiments described below with reference to the accompanying drawings. However, the present disclosure is not limited to the following exemplary embodiments but may be implemented in various different forms. The exemplary embodiments are provided only to complete disclosure of the present disclosure and to fully provide a person having ordinary skill in the art to which the present disclosure pertains with the category of the disclosure, and the present disclosure will be defined by the appended claims.

The shapes, sizes, ratios, angles, numbers, and the like illustrated in the accompanying drawings for describing the exemplary embodiments of the present disclosure are merely examples, and the present disclosure is not limited thereto. Further, in the following description, a detailed explanation of well-known related technologies may be omitted to avoid unnecessarily obscuring the subject matter of the present disclosure. The terms such as "including," "having," and "consist of" used herein are generally intended to allow other components to be added unless the terms are used with the term "only". Any references to singular may include plural unless expressly stated otherwise.

Components are interpreted to include an ordinary error range even if not expressly stated.

When the position relation between two parts is described using the terms such as "on", "above", "below", and "next", one or more parts may be positioned between the two parts unless the terms are used with the term "immediately" or "directly".

When an element or layer is referred to as being "on" another element or layer, it may be directly on the other element or layer, or intervening elements or layers may be present.

Although the terms "first", "second", and the like are used for describing various components, these components are not confined by these terms. These terms are merely used for distinguishing one component from the other components. Therefore, a first component to be mentioned below may be a second component in a technical concept of the present disclosure.

Throughout the whole specification, the same reference numerals denote the same elements.

Since the size and thickness of each component illustrated in the drawings are represented for convenience in explanation, the present disclosure is not necessarily limited to the illustrated size and thickness of each component.

The features of various embodiments of the present disclosure can be partially or entirely bonded to or combined with each other and can be interlocked and operated in technically various ways, and the embodiments can be carried out independently of or in association with each other.

In the present disclosure, a TFT may be of a P-type or an N-type, and in the following exemplary embodiments, a TFT will be described as being of an N-type for convenience in explanation. Also, in explaining pulse-type signals, a gate high voltage (VGH) state is defined as "high state" and a gate low voltage (VGL) state is defined as "low state".

Hereinafter, various exemplary embodiments of the present disclosure will be described in detail with reference to the accompanying drawings.

FIG. 1 is a schematic block diagram provided to explain an organic light emitting diode display device according to an exemplary embodiment of the present disclosure.

Referring to FIG. 1, an organic light emitting diode display device 100 includes a display panel 110 including a plurality of pixels P and a gate driver 130 that supplies a gate signal to each of the plurality of pixels P. Also, the organic light emitting diode display device 100 includes a data driver 140 that supplies a data signal to each of the plurality of pixels P and a timing controller 120 that controls the gate driver 130 and the data driver 140.

The timing controller 120 processes image data RGB input from the outside so as to be suitable for the size and resolution of the display panel 110, and then supplies the image data RGB to the data driver 140. The timing controller 120 generates a plurality of gate and data control signals GSC and DCS by using synchronization signals SYNC, for example, a dot clock signal DCLK, a data enable signal DE, a horizontal synchronization signal Hsync, and a vertical synchronization signal Vsync, which are input from the outside. Further, the timing controller 120 supplies the generated gates and data control signals GCS and DCS to the gate driver 130 and the data driver 140, respectively, and thus controls the gate driver 130 and the data driver 140.

The gate driver 130 supplies a gate signal to a gate line GL in response to the gate control signal GCS supplied from the timing controller 120. Herein, the gate signal includes at least one scan signal and an emission control signal. Although FIG. 1 illustrates that the gate driver 130 is disposed on one side of the display panel 110 as being spaced from the display panel 110, the number and position of the gate drivers 130 is not limited thereto. That is, the gate driver 130 may be disposed on one side or both sides of the display panel 110 in a GIP (Gate In Panel) manner.

The data driver 140 converts the image data RGB into a data voltage in response to a data control signal DCS supplied from the timing controller 120 and supplies the converted data voltage to the pixel P through a data line DL.

In the display panel 110, a plurality of gate lines GL and a plurality of data lines DL are disposed to intersect with each other and each of the plurality of pixels P is connected to the gate lines GL and the data lines DL. Specifically, each pixel P is supplied with a gate signal from the gate driver 130 through a gate line GL, a data signal from the data driver 140 through a data line DL, and various powers through a power supply line. Herein, the gate line GL includes a first scan signal line SCAN1, a second scan signal line SCAN2, a third scan signal line SCAN3, a first emission control signal line EM1, and a second emission control signal line EM2. Further, the data line DL includes a data voltage line Vdata and at least one reference voltage line Vref. Thus, each pixel P receives a scan signal and an emission control signal through the gate line GL, a data voltage and a reference voltage through the data line DL, and a high-potential voltage VDD, a low-potential voltage VSS, and an initialization voltage Vinit through the power supply line.

Also, each pixel P includes an organic light emitting diode and a pixel driving circuit configured to control driving of the organic light emitting diode. Herein, the organic light emitting diode includes an anode, a cathode, and an organic emission layer between the anode and the cathode. The pixel driving circuit includes a plurality of switching elements, a driving switching element, and a capacitor. Herein, the switching element may be configured as a TFT. In the pixel driving circuit, a driving TFT controls the amount of current to be supplied to the organic light emitting diode depending on a difference between a data voltage charged in the capacitor and a reference voltage so as to control the amount of light emission of the organic light emitting diode. Further, the plurality of switching TFTs receives scan signals and emission control signals supplied through the gate lines GL and charges the capacitor with a data voltage.

The organic light emitting diode display device 100 according to an exemplary embodiment of the present disclosure includes the gate driver 130 and the data driver 140 for driving the display panel 110 including the plurality of pixels P, and the timing controller 120 for controlling the gate driver 130 and the data driver 140. Herein, each of the plurality of pixels P includes the pixel driving circuit, and the data voltage line Vdata and at least one reference voltage line Vref are connected to the pixel driving circuit. Therefore, a data voltage and a reference voltage may be supplied to the pixel driving circuit through different lines, respectively, during the same period of time. With the pixel driving circuit configured as such, the time required to write a data voltage for making the organic light emitting diode emit light and to compensate a characteristic difference of the driving TFT can be reduced. A detailed configuration of the pixel driving circuit disposed on each of the plurality of pixels P will be described below with reference to FIG. 2.

Figure 2:
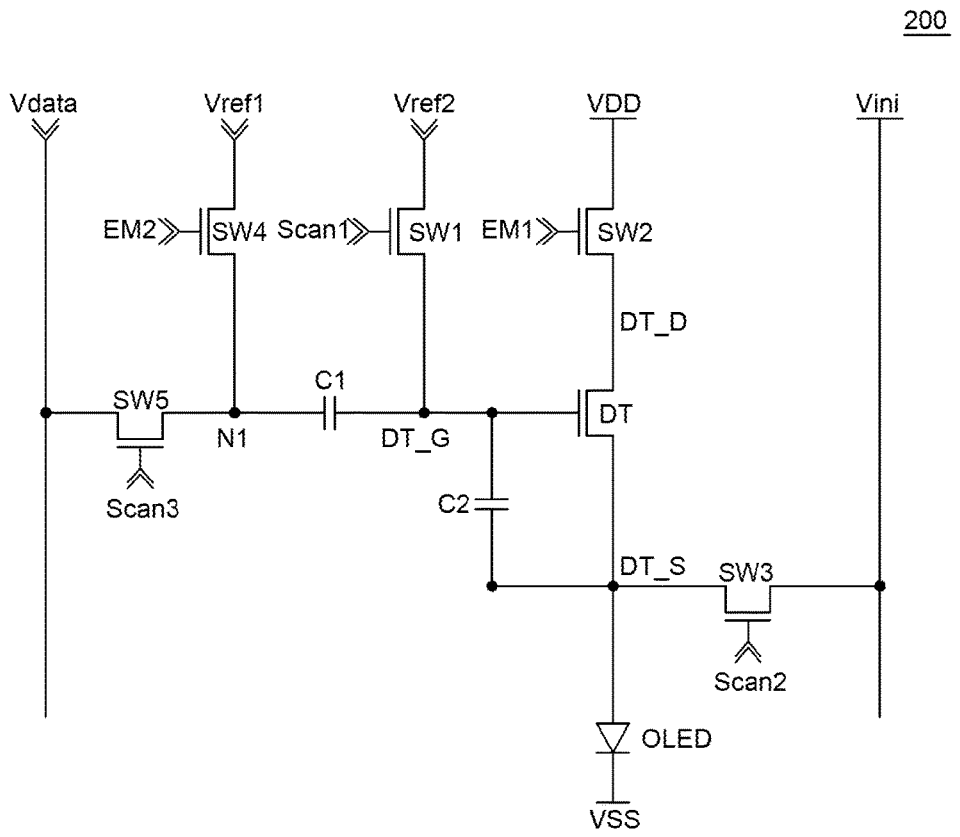
FIG. 2 is a circuit diagram illustrating a configuration of a pixel driving circuit according to an exemplary embodiment of the present disclosure.

FIG. 2 is a circuit diagram illustrating a configuration of a pixel driving circuit according to an exemplary embodiment of the present disclosure.

Referring to FIG. 2, a pixel driving circuit 200 includes a driving TFT DT, five switching TFTs SW1 to SW5, and two capacitors C1 and C2. Herein, a TFT is an example of a switching element. Hereinafter, a driving switching element will be described as a driving TFT and a switching element will be described as a switching TFT.

The driving TFT DT includes a gate DT_G connected to the first capacitor C1 and the second capacitor C2, a source DT_S connected to an organic light emitting diode OLED, and a drain DT_G connected to the second switching TFT SW2. Herein, the driving TFT DT is electrically connected to the organic light emitting diode OLED and electrically connected between a high-potential voltage supply line VDD and a low-potential voltage supply line VSS.

The first switching TFT SW1 includes a gate connected to the first scan signal line Scan1, a drain connected to a second reference voltage line Vref2, and a source connected to the gate DT_G of the driving TFT DT.

The switching TFT SW2 includes a gate connected to the first emission control signal line EM1, a drain connected to the high-potential voltage supply line VDD, and a source connected to the drain DT_G of the driving TFT DT.

The third switching TFT SW3 includes a gate connected to the second scan signal line Scan2, a drain connected to an initialization voltage line Vini, and a source connected to the source DT_S of the driving TFT DT.

The fourth switching TFT SW4 includes a gate connected to the second emission control signal line EM2, a drain connected to a first reference voltage line Vref1, and a source connected to a first node N1.

The fifth switching TFT SW5 includes a gate connected to the third scan signal line Scan3, a drain connected to the data voltage line Vdata, and a source connected to the first node N1.

The first capacitor C1 is connected between the gate DT_G of the driving TFT DT and the first node N1.

The second capacitor C2 is connected between the gate DT_G of the driving TFT DT and the source DT_S of the driving TFT DT.

Specifically, if a voltage higher than a threshold voltage (hereinafter, referred to as "Vth") is applied to the gate DT_G of the driving TFT DT, the driving TFT DT is turned on. Thus, the drain DT_D of the driving TFT DT is electrically connected to the high-potential voltage supply line VDD and the source DT_S of the driving TFT DT is electrically connected to the organic light emitting diode OLED. Therefore, if a voltage of the gate DT_G of the driving TFT DT is higher than Vth, the driving TFT DT supplies a driving current Ids to the organic light emitting diode OLED to make the organic light emitting diode OLED emit light.

If a high voltage is applied through the first scan signal line Scan1, the first switching TFT SW1 is turned on and supplies a second reference voltage from the second reference voltage line Vref2 to the gate DT_G of the driving TFT DT.

If a high voltage is applied through the first emission control signal line EM1, the second switching TFT SW2 is turned on and supplies a high-potential voltage from the high-potential voltage supply line VDD to the drain DT_D of the driving TFT DT.

If a high voltage is applied through the second scan signal line Scan2, the third switching TFT SW3 is turned on and supplies an initialization voltage from the initialization voltage line Vini to the source DT_S of the driving TFT DT.

If a high voltage is applied through the second emission control signal line EM2, the fourth switching TFT SW4 is turned on and supplies a first reference voltage from the first reference voltage line Vref1 to the first node N1.

If a high voltage is applied through the third scan signal line Scan3, the fifth switching TFT SW5 is turned on and supplies a data voltage from the data voltage line Vdata to the first node N1.

The first capacitor C1 stores a difference between a voltage of the gate DT_G of the driving TFT DT and a voltage of the first node N1.

The second capacitor C2 stores a difference between a voltage of the gate DT_G of the driving TFT DT and a voltage of the source DT_S of the driving TFT DT. Further, if a high voltage is applied through the first emission control signal line EM1 and the second switching TFT SW2 is turned on, the driving TFT DT operates as a source follower. Thus, the second capacitor C2 stores a voltage between the gate DT_G of the driving TFT DT and the source DT_S of the driving TFT DT. Herein, the voltage stored in the second capacitor C2 is Vth, and the second capacitor C2 performing such a function may be referred to as "storage capacitor".

Further, the first capacitor C1 and the second capacitor C2 are connected to each other in electrical series. Specifically, if the first capacitor C1 and the second capacitor C2 are connected in series between the first node N1 and the source DT_S of the driving TFT DT, a voltage of the gate DT_G of the driving TFT DT and a voltage of the source DT_S of the driving TFT DT may be changed due to capacitor coupling. That is, a voltage of the gate DT_G of the driving TFT DT and a voltage of the source DT_S of the driving TFT DT may be distributed due to capacitor coupling caused by a series connection between the first capacitor C1 and the second capacitor C2.

The pixel driving circuit 200 according to an exemplary embodiment of the present disclosure includes the one driving TFT DT, the five switching TFTs SW1 to SW5, and the two capacitors C1 and C2. In the pixel driving circuit 200, the at least one reference voltage line Vref is connected to a switching TFT and the data voltage line Vdata is connected to another switching TFT. That is, in the pixel driving circuit 200, the data voltage line Vdata and the at least one reference voltage line Vref are connected to different switching TFTs. Therefore, if the fifth switching TFT SW5 connected to the data voltage line Vdata is turned on, a data voltage is applied to the first node N1. If the first switching TFT SW1 connected to the second reference voltage line Vref2 is turned on, a second reference voltage is applied to the gate DT_G of the driving TFT DT.

Further, in the pixel driving circuit 200 according to an exemplary embodiment of the present disclosure, the data voltage line Vdata and the at least one reference voltage line Vref1 and Vref2 are connected to different switching TFTs. Thus, programming for writing a data voltage on the first node N1 and sampling caused by a source follower of the driving TFT DT when a second reference voltage is applied to the gate DT_G of the driving TFT DT may be simultaneously performed. Detailed operations of the pixel driving circuit 200 in the respective periods in response to input/output signals applied to the pixel driving circuit 200 will be described below with reference to FIG. 3 through FIG. 7.

Figure 3:
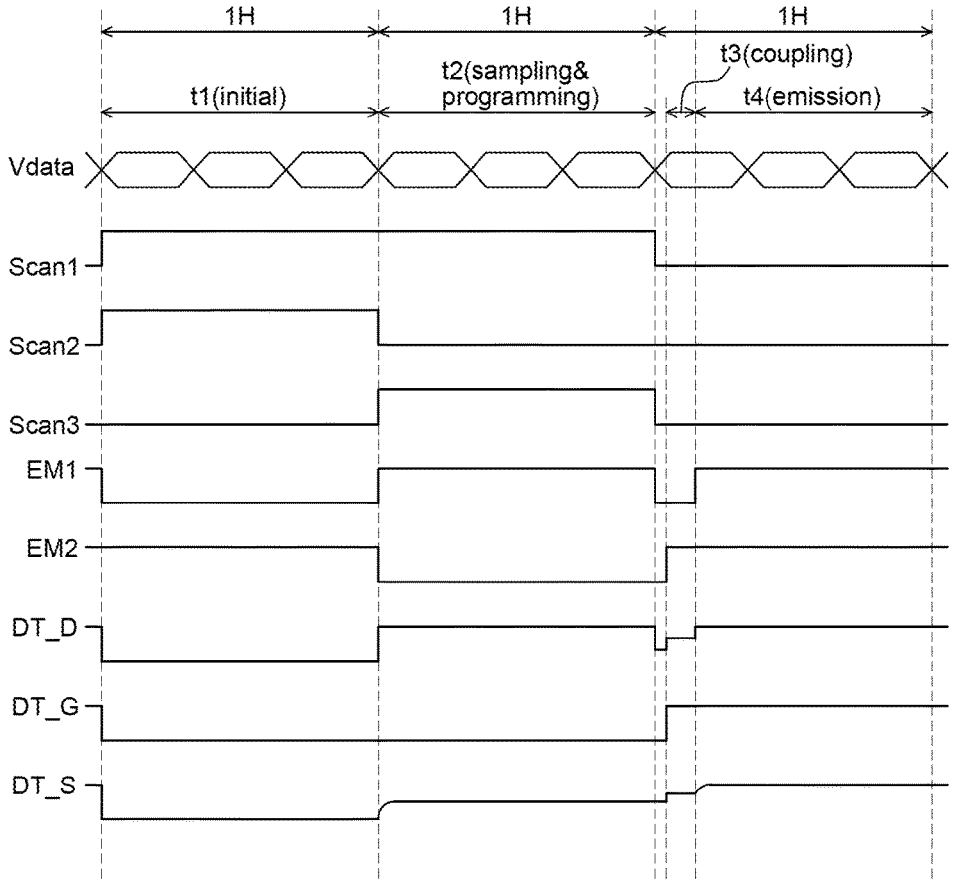
FIG. 3 is a waveform diagram illustrating input/output signals in the pixel driving circuit illustrated in FIG. 2 according to an exemplary embodiment of the present disclosure.
Figure 4:
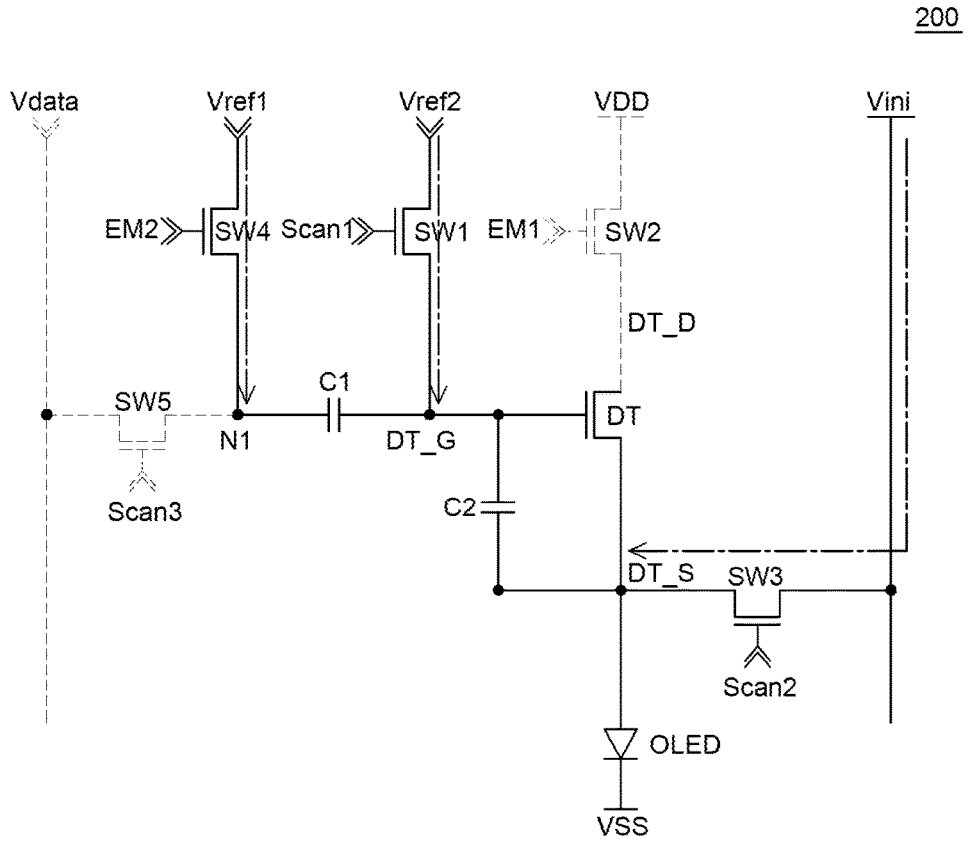
FIG. 4 is a circuit diagram illustrating a signal flow in the pixel driving circuit during the initialization period illustrated in FIG. 3 according to an exemplary embodiment of the present disclosure.
Figure 5:
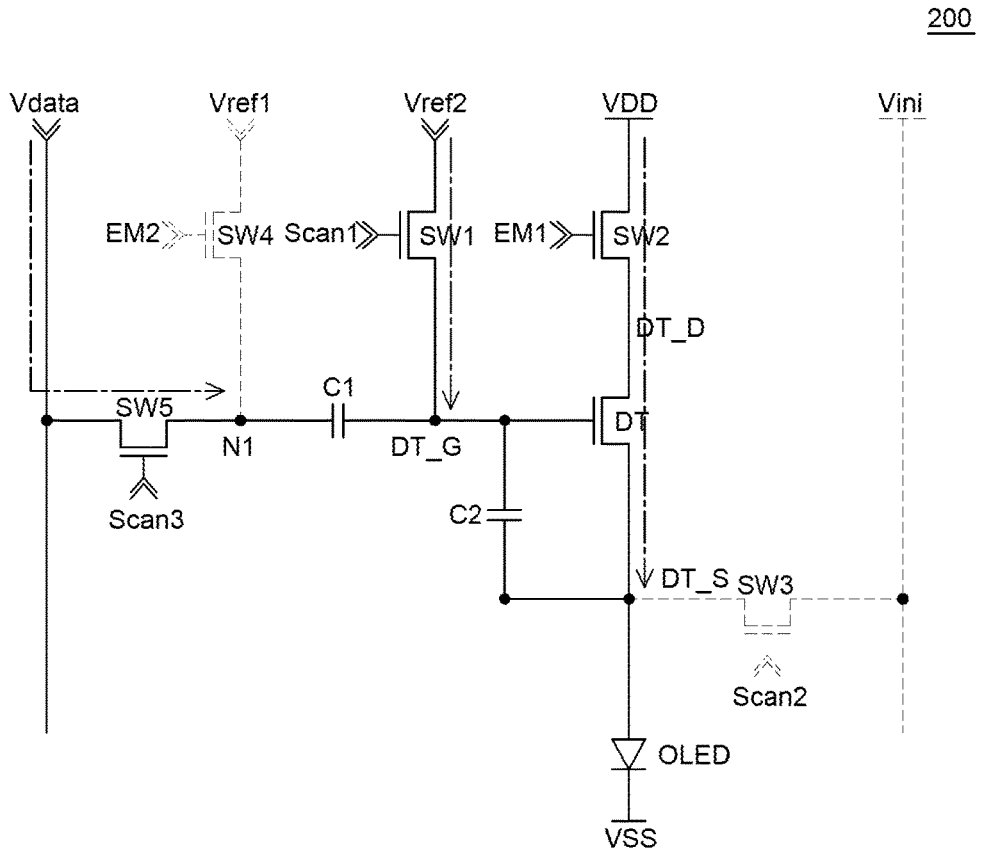
FIG. 5 is a circuit diagram illustrating a signal flow in the pixel driving circuit during the sampling period and the programming period illustrated in FIG. 3 according to an exemplary embodiment of the present disclosure.
Figure 6:
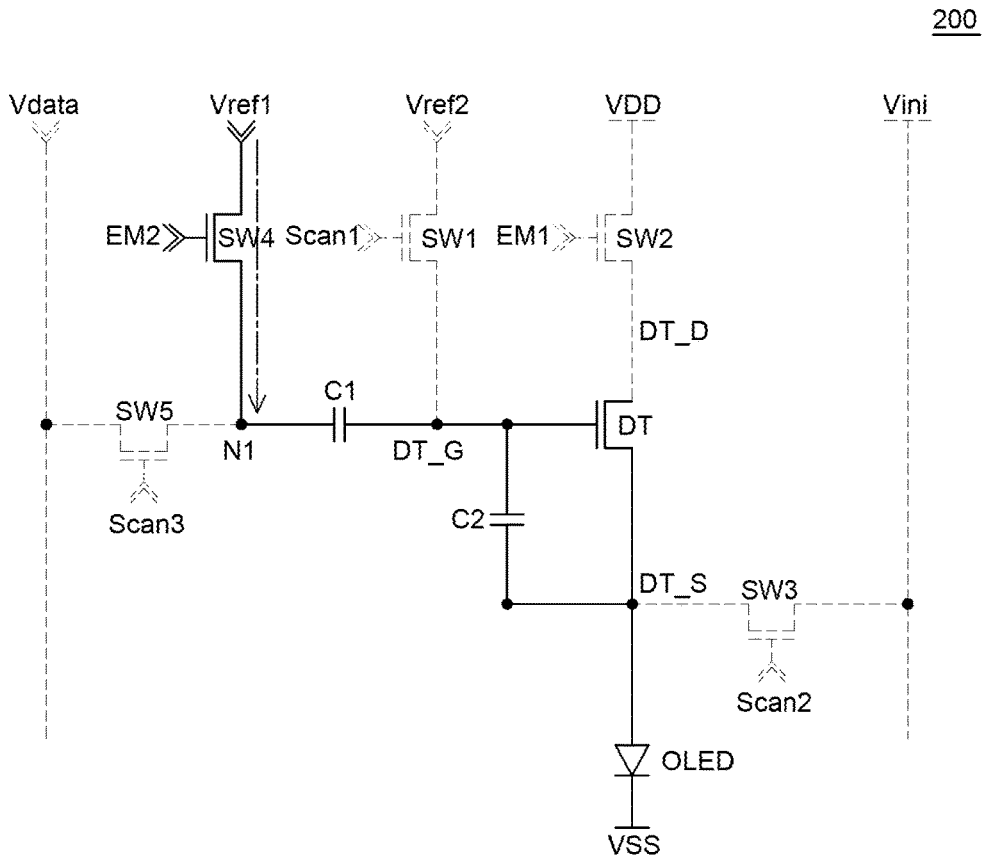
FIG. 6 is a circuit diagram illustrating a signal flow in the pixel driving circuit during the coupling period illustrated in FIG. 3 according to an exemplary embodiment of the present disclosure.
Figure 7:
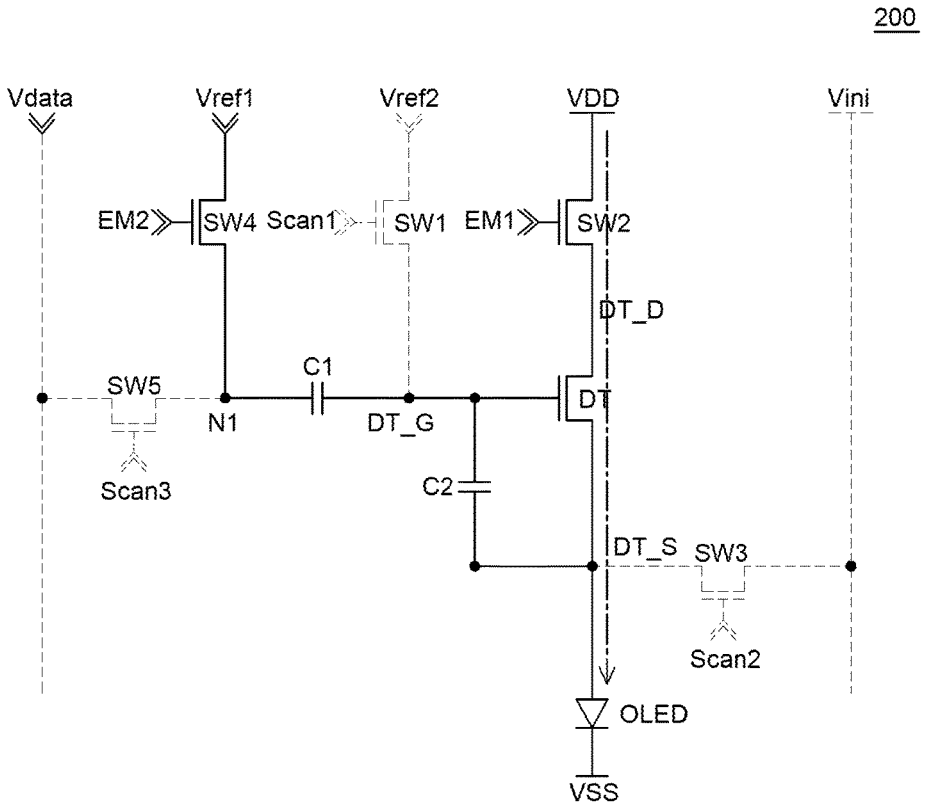
FIG. 7 is a circuit diagram illustrating a signal flow in the pixel driving circuit during the emission period illustrated in FIG. 3 according to an exemplary embodiment of the present disclosure.

FIG. 3 is a waveform diagram illustrating input/output signals in the pixel driving circuit illustrated in FIG. 2 according to an exemplary embodiment of the present disclosure. FIG. 4 is a circuit diagram illustrating a signal flow in the pixel driving circuit during the initialization period illustrated in FIG. 3 according to an exemplary embodiment of the present disclosure. FIG. 5 is a circuit diagram illustrating a signal flow in the pixel driving circuit during the sampling period and the programming period illustrated in FIG. 3 according to an exemplary embodiment of the present disclosure. FIG. 6 is a circuit diagram illustrating a signal flow in the pixel driving circuit during the coupling period illustrated in FIG. 3 according to an exemplary embodiment of the present disclosure. FIG. 7 is a circuit diagram illustrating a signal flow in the pixel driving circuit during the emission period illustrated in FIG. 3 according to an exemplary embodiment of the present disclosure. The circuit diagrams illustrated in FIG. 4 through FIG. 7 are provided to explain signal flows during periods divided according to input/output signals and include substantially the same components as the circuit diagram illustrated in FIG. 2. Therefore, a redundant explanation of the configuration of the pixel driving circuit 200 will be omitted. A dashed-dotted line in FIG. 4 through FIG. 7 indicates the flow of an internal signal caused by a signal input into the pixel driving circuit 200, and a dotted line indicates a portion which is not activated by the signal input into the pixel driving circuit 200. For convenience in explanation, FIG. 1 will also be referred to hereinafter.

Referring to FIG. 3, each pixel P according to the present disclosure operates in a period divided into an initialization period t1, a sampling and programming period t2, a coupling period t3, and an emission period t4, in response to pulse timings of a plurality of scan signals and emission control signals supplied to the pixel driving circuit 200.

In the initialization period t1, a first scan signal Scan1 and a second scan signal Scan2 are output in a high state, and a third scan signal Scan3 is output in a low state. Further, a first emission control signal EM1 is output in a low state and a second emission control signal EM2 is output in a high state.

In the sampling and programming period t2, the first scan signal Scan1 is output in a continuously high state, the second scan signal Scan2 is output in a low state, and the third scan signal Scan3 is output in a high state. Further, the first emission control signal EM1 is output in a high state and the second emission control signal EM2 is output in a low state.

In the coupling period t3, the first scan signal Scan1, the second scan signal Scan2 and the third scan signal Scan3 are output in a low state. Further, the first emission control signal EM1 is output in a low state and the second emission control signal EM2 is output in a high state changed from a low state.

In the emission period t4, the first scan signal Scan1, the second scan signal Scan2 and the third scan signal Scan3 are output in a continuously low state. Further, the first emission control signal EM1 and the second emission control signal EM2 are output in a high state.

During the 1 horizontal period 1 H, a data voltage is continuously supplied. Specifically, data voltages corresponding to R, G, and B, respectively, may be separately supplied during the 1 horizontal period 1 H. For example, each of the data voltages corresponding to R, G, and B, respectively, may be individually supplied during ⅓ H. A duration of supplying each of the data voltages corresponding to R, G, and B, respectively, may be from about 2 μsec to about 4 μsec. That is, the 1 horizontal period 1 H may be from about 6 μsec to about 13 μsec, and the data voltages may be continuously applied during the 1 horizontal period 1 H.

In FIG. 3, a first 1 horizontal period 1 H refers to a period in which a scan signal and an emission control signal are supplied to an n−1th gate line GL, and a second 1 horizontal period 1 H refers to a period in which the scan signal and the emission control signal are supplied to an nth gate line GL. Further, a third horizontal period 1 H refers to a period in which the scan signal and the emission control signal are supplied to an n+1th gate line GL. For example, if a gate signal is input into the nth gate line GL connected to the pixel driving circuit 200 during the second 1 horizontal period 1 H, the first 1 horizontal period 1 H refers to a period in which the gate signal is input into a pixel driving signal connected to the previous gate line of the pixel driving circuit 200. Also, the third 1 horizontal period 1 H refers to a period in which the gate signal is input into a pixel driving signal connected to the next gate line of the pixel driving circuit 200.

If the second 1 horizontal period 1 H is a period in which a gate signal is input into the pixel driving circuit 200, the 1 horizontal period 1 H includes a sampling period and a programming period. Herein, if the 1 horizontal period 1 H includes the sampling period and the programming period, the sampling period and the programming period may be overlapped at least in part with each other. That is, sampling and programming may be simultaneously performed during the 1 horizontal period 1 H. In other words, during the 1 horizontal period 1 H, a voltage in the source DT_S of the driving TFT DT may be sampled and a data voltage Vdata may be applied to the first node N1 at the same time. A detailed operation of the pixel driving circuit 200 in the sampling and programming period t2 will be described later with reference to FIG. 5.

Referring to FIG. 3 and FIG. 4, in the pixel driving circuit 200 during the initialization period t1, the third switching TFT SW3 is turned on and initializes a voltage in the source DT_S of the driving TFT DT.

Specifically, during the initialization period t1, the first scan signal Scan1, the second scan signal Scan2 and the second emission control signal EM2 are in a high state. Therefore, the first switching TFT SW1, the third switching TFT SW3 and the fourth switching TFT SW4 are turned on.

Accordingly, the first switching TFT SW1 is turned on and thus applies the second reference voltage Vref2 to the gate DT_G of the driving TFT DT. Also, the fourth switching TFT SW4 is turned on and thus applies the first reference voltage Vref1 to the first node N1. Further, the initialization voltage Vini is applied to the source DT_S of the driving TFT DT through the third switching TFT SW3, and, thus, the pixel P is initialized.

Herein, the first reference voltage Vref1 and the second reference voltage Vref2 may have different potentials. By variously controlling the potentials of the first reference voltage Vref1 and the second reference voltage Vref2, the magnitudes of a driving voltage and a driving current of the driving TFT DT can be controlled using various differences between the first reference voltage Vref1 and the second reference voltage Vref2. That is, the degree of freedom of the driving voltage and the driving current of the driving TFT DT depending on various reference voltages can be increased.

Then, referring to FIG. 3 and FIG. 5, in the pixel driving circuit 200 during the sampling and programming period t2, the second switching TFT SW2 is turned on and samples the voltage in the source DT_S of the driving TFT DT. Also, the fifth switching TFT SW5 is turned on and writes and programs the data voltage Vdata on the first node N1.

Specifically, during the sampling and programming period t2, the first scan signal Scan1, the third scan signal Scan3 and the first emission control signal EM1 are in a high state. Therefore, the first switching TFT SW1, the second switching TFT SW2 and the fifth switching TFT SW5 are turned on.

Accordingly, the first switching TFT SW1 is turned on, and, thus, the gate DT_G of the driving TFT DT is maintained at the second reference voltage Vref2. Further, the second switching TFT SW2 is turned on, and, thus, the high-potential voltage supply line VDD is connected to the drain DT_D of the driving TFT DT and the source DT_S and the gate DT_G of the driving TFT DT operate as source followers. That is, sampling is performed until a voltage Vgs between the gate DT_G of the driving TFT DT and the source DT_S of the driving TFT DT reaches Vth. In this case, a voltage in the gate DT_G of the driving TFT DT is equal to Vref2 and a voltage in the source DT_S of the driving TFT DT is equal to Vref2−Vth. Thus, Vth is sampled and stored in the second capacitor C2 connected between the gate DT_G of the driving TFT DT and the source DT_S of the driving TFT DT.

Further, during the sampling and programming period t2, the third switching TFT SW3 is turned on, and, thus, the data voltage Vdata is applied to the first node N1. That is, during the sampling and programming period t2, the voltage Vgs between the gate DT_G of the driving TFT DT and the source DT_S of the driving TFT DT is sampled and the data voltage Vdata is applied to the first node N1 at the same time. Thus, the pixel P is programmed with the data voltage Vdata.

Herein, the first capacitor C1 is connected between the gate DT_G of the driving TFT DT and the first node N1 and stores a difference between a voltage of the gate DT_G of the driving TFT DT and a voltage of the first node N1. That is, the first capacitor C1 may store Vdata-Vref2 and apply Vdata-Vref2 to the voltage Vgs between the gate DT_G of the driving TFT DT and the source DT_S of the driving TFT DT during the subsequent coupling period t3 to compensate the magnitudes of a driving voltage and a driving current Ids of the driving TFT DT.

Then, referring to FIG. 3 and FIG. 6, in the pixel driving circuit 200 during the coupling period t3, the fourth switching TFT SW4 is turned on and thus performs coupling by writing the first reference voltage Vref1 on the first node N1.

Specifically, during the coupling period t3, only the second emission control signal EM is in a high state. Therefore, only the fourth switching TFT SW4 is turned on. Since the fourth switching TFT SW4 is turned on, the first reference voltage Vref1 is applied to the first node N1.

Accordingly, a voltage in the first node N1 is changed from the data voltage Vdata which is a voltage maintained during the sampling and programming period t2, and the first reference voltage Vref1 is applied to the first node N1.

Further, during the coupling period t3, the voltage in the gate DT_G of the driving TFT DT and the voltage in the source DT_S of the driving TFT DT are changed due to coupling between the first capacitor C1 and the second capacitor C2.

Specifically, during the coupling period t3, the first capacitor C1 and the second capacitor C2 are connected to each other in electrical series between the first node N1 and the source DT_S of the driving TFT DT. Thus, capacitor coupling occurs according to voltage distribution caused by a series connection between the first capacitor C1 and the second capacitor C2. That is, since a voltage in the first node N1 is applied with the first reference voltage Vref1, the voltage in the gate DT_G of the driving TFT DT and the voltage in the source DT_S of the driving TFT DT are changed due to capacitor coupling. In other words, the voltage in the gate DT_G of the driving TFT DT is changed from Vref2 to Vref2-C' (Vref1−Vdata) and the voltage in the source DT_S of the driving TFT DT is changed from Vref2−Vth to Vref2−Vth−C" (Vref1−Vdata) due to capacitor coupling. Herein, the C' is equal to (C1/(C1+C2+Coled)) and C" is equal to (C2/(C1+C2+Coled)).

Accordingly, the voltage Vgs between the gate DT_G of the driving TFT DT and the source DT_S of the driving TFT DT can be compensated to Vth+(C"−C')*(Vref1−Vdata) during the coupling period t3. That is, Vgs is compensated by (C"−C')*(Vref1−Vdata) through the sampling and programming period t2 and the coupling period t3.

Then, referring to FIG. 3 and FIG. 7, in the pixel driving circuit 200 during the emission period t4, all the second switching TFT SW2 and the driving TFT DT are turned on and make the organic light emitting diode OLED emit light.

Specifically, during the emission period t4, all the first emission control signal EM1 and the second emission control signal EM2 are in a high state. Therefore, the fourth switching TFT SW4 and the second switching TFT SW2 are turned on.

Accordingly, the voltage in the first node N1 is fixed to the first reference voltage Vref1 during the emission period t4. Therefore, the voltage Vgs between the gate DT_G of the driving TFT DT and the source DT_S of the driving TFT DT can be maintained at the same level as in the coupling period t3. That is, while Vgs in the coupling period t3 is maintained during the emission period t4, the driving TFT DT is turned on, and, thus, a driving voltage is supplied to the organic light emitting diode OLED. Then, the driving voltage causes a driving current Ioled=K(Vref1−Vdata)$^2$ to flow in the organic light emitting diode OLED. Herein, K is equal to μ*Cox*W/L and corresponds to a value determined depending on characteristics of the driving TFT DT.

That is, in the emission period t4, the pixel driving circuit 200 according to the present disclosure causes a constant driving current to flow in the organic light emitting diode OLED. The driving current is determined only by a difference of Vref1−Vdata and thus can be compensated so as not to be affected by Vth of the driving TFT DT.

The pixel driving circuit 200 according to an exemplary embodiment of the present disclosure operates in a period divided into the initialization period t1, the sampling and programming period t2, the coupling period t3, and the emission period t4, in response to pulse timings of three scan signals and two emission control signals. Particularly, the pixel driving circuit 200 may be configured such that the data voltage line Vdata and the at least one reference voltage line Vref1 and Vref2 are separated from each other. Therefore, the second switching TFT SW2 is turned on in response to a pulse timing of a gate signal. Thus, sampling may be performed by a source follower of the driving TFT DT and programming for writing a data voltage through the data voltage line Vdata may be performed at the same time.

Further, the initialization period t1 may exist during a 1 horizontal period 1 H corresponding to the previous gate line of the pixel driving circuit 200, in response to a pulse timing for driving the pixel driving circuit 200 according to an exemplary embodiment of the present disclosure. Therefore, during 1 horizontal period 1 H, only sampling and programming may be simultaneously performed. That is, during the 1 horizontal period 1 H, sampling and programming are performed and only the data voltage Vdata swings. Thus, the 1 horizontal period 1 H may be reduced to about 13 μsec which is the duration of substantially applying the data voltage Vdata to a single pixel P. Furthermore, in the pixel driving circuit 200 according to an exemplary embodiment of the present disclosure, each of the initialization period and the sampling period can be secured to a 1 horizontal period 1 H. Therefore, it is possible to solve insufficient compensation caused by insufficient initialization or sampling of the pixel P due to the insufficient initialization period and sampling period. It is also possible to improve various defects of an organic light emitting diode display device and deterioration of panel performance caused by insufficient compensation.

Moreover, since the 1 horizontal period 1 H can be reduced, an organic light emitting diode display device including the pixel driving circuit 200 according to an exemplary embodiment of the present disclosure can be manufactured to have a greater size by increasing the number of gate lines GL. An organic light emitting diode display device including the same number of gate lines GL can be manufactured to be driven at a higher frequency.

Figure 8:
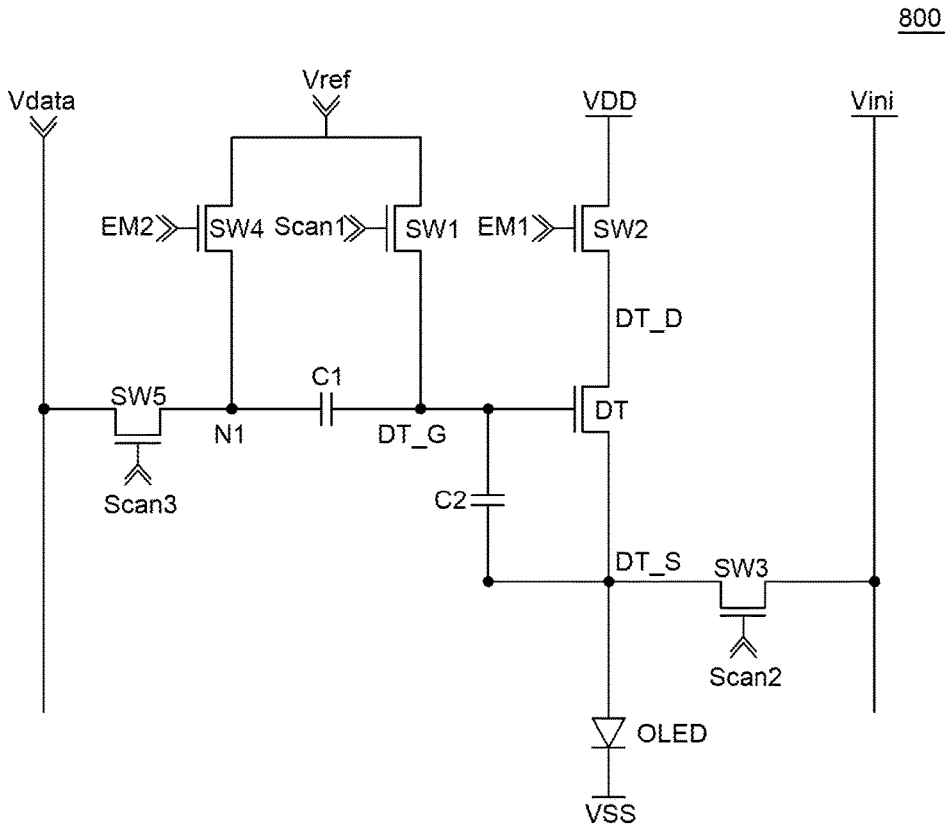
FIG. 8 is a circuit diagram illustrating a configuration of a pixel driving circuit according to another exemplary embodiment of the present disclosure.

FIG. 8 is a circuit diagram illustrating a configuration of a pixel driving circuit according to another exemplary embodiment of the present disclosure. A pixel driving circuit 800 illustrated in FIG. 8 is substantially the same as the pixel driving circuit 200 illustrated in FIG. 2 except a configuration of the reference voltage line Vref. Therefore, a redundant explanation thereof will be omitted. For convenience in explanation, FIG. 3 will also be referred to hereinafter.

Referring to FIG. 8, the first switching TFT SW1 and the fourth switching TFT SW4 are connected to a same reference voltage line Vref. Specifically, a drain of the first switching TFT SW1 and a drain of the fourth switching TFT SW4 are commonly connected to a single reference voltage line Vref.

If a high voltage is applied through the first scan signal line Scan1, the first switching TFT SW1 is turned on and thus supplies a reference voltage from the reference voltage line Vref to the gate DT_G of the driving TFT DT. If a high voltage is applied through the second emission control signal line EM2, the fourth switching TFT SW4 is turned on and thus supplies a reference voltage from the reference voltage line Vref to the first node N1.

In the initialization period t1, all the first switching TFT SW1 and the fourth switching TFT SW4 are turned on, and, thus, the same reference voltage Vref is applied to the gate DT_G of the driving TFT DT and the first node N1.

Then, in the sampling and programming period t2, the first switching TFT SW1 is turned on and the fourth switching TFT SW4 is turned off, and, thus, the gate DT_G of the driving TFT DT is maintained at the reference voltage. Further, the second switching TFT SW2 is turned on, and, thus, the high-potential voltage supply line VDD is connected to the drain DT_D of the driving TFT DT and the source DT_S and the gate DT_G of the driving TFT DT operate as source followers. That is, sampling is performed until the voltage Vgs between the gate DT_G of the driving TFT DT and the source DT_S of the driving TFT DT reaches Vth. In this case, a voltage in the gate DT_G of the driving TFT DT is equal to Vref and a voltage in the source DT_S of the driving TFT DT is equal to Vref-Vth. Thus, Vth is sampled and stored in the second capacitor C2 connected between the gate DT_G of the driving TFT DT and the source DT_S of the driving TFT DT.

Herein, the first capacitor C1 is connected between the gate DT_G of the driving TFT DT and the first node N1 and stores Vdata-Vref. Then, the first capacitor C1 applies Vdata-Vref to the voltage Vgs between the gate DT_G of the driving TFT DT and the source DT_S of the driving TFT DT during the subsequent coupling period t3 to compensate the magnitudes of a driving voltage and a driving current Ids of the driving TFT DT.

Then, in the coupling period t3, the first switching TFT SW1 is turned off and the fourth switching TFT SW4 is turned on, and, thus, the reference voltage Vref is applied to the first node N1. Thus, during the coupling period t3, the reference voltage Vref is applied to the first node N1. Further, due to capacitor coupling caused by a series connection between the first capacitor C1 and the second capacitor C2, the voltage in the gate DT_G of the driving TFT DT is changed from Vref to Vref-C' (Vref-Vdata) and the voltage in the source DT_S of the driving TFT DT is changed from Vref−Vth to Vref−Vth−C" (Vref−Vdata). Accordingly, the voltage Vgs between the gate DT_G of the driving TFT DT and the source DT_S of the driving TFT DT can be compensated to Vth+(C"−C')*(Vref-Vdata) during the coupling period t3. That is, Vgs is compensated by (C"−C')*(Vref-Vdata) through the sampling and programming period t2 and the coupling period t3.

Then, in the emission period t4, the first switching TFT SW1 is turned off and the fourth switching TFT SW4 is turned on, and, thus, the voltage in the first node N1 is fixed to the reference voltage Vref. As the driving TFT DT is turned on, a driving current Ioled=K(Vref-Vdata)$^2$ flows in the organic light emitting diode OLED. That is, the driving current flowing in the organic light emitting diode OLED by the pixel driving circuit 200 of the present disclosure during the emission period t4 is determined only by a difference of Vref-Vdata. Thus, the driving current can be compensated so as not to be affected by Vth of the driving TFT DT.

The pixel driving circuit 800 according to another exemplary embodiment of the present disclosure may be configured such that a plurality of reference voltage lines is integrated as one and the same reference voltage line. That is, in the pixel driving circuit 800 according to another exemplary embodiment of the present disclosure, the number of reference voltage lines Vref can be reduced by unifying reference voltages as one reference voltage. Therefore, in the pixel driving circuit 800, only one reference voltage line Vref may be disposed. Accordingly, in the entire organic light emitting diode display device, the number of reference voltage lines Vref can be greatly reduced. Further, in an organic light emitting diode display device having the same size, the number of reference voltage lines Vref can be increased. Thus, a high-resolution organic light emitting diode display device can be manufactured.

The exemplary embodiments of the present disclosure can also be described as follows:

According to an aspect of the present disclosure, there is provided an organic light emitting diode display device. The organic light emitting diode display device includes an organic light emitting diode disposed on each of a plurality of pixels, and a pixel driving circuit configured to drive the organic light emitting diode. The pixel driving circuit includes a driving switching element electrically connected to the organic light emitting diode and electrically connected between a high-potential voltage supply line and a low-potential voltage supply line. Further, the pixel driving circuit includes a first switching element connected to a gate of the driving switching element and a first scan signal line. Furthermore, the pixel driving circuit includes a second switching element connected to a drain of the driving switching element and a first emission control signal line. Moreover, the pixel driving circuit includes a first capacitor connected between the gate of the driving switching element and a first node. Further, the pixel driving circuit includes a third switching element connected to a source of the driving switching element, a second scan signal line, and an initialization voltage line. Furthermore, the pixel driving circuit includes a fourth switching element connected to the first node and a second emission control signal line. Moreover, the pixel driving circuit includes a fifth switching element connected to the first node, a third scan signal line, and a data voltage line. Further, the pixel driving circuit includes a second capacitor connected between the gate of the driving switching element and the source of the driving switching element. In the organic light emitting diode display device according to an exemplary embodiment of the present disclosure, it is possible to remarkably reduce a 1 horizontal period by simultaneously performing sampling and programming during the 1 horizontal period.

The pixel driving circuit may operate in a period divided into an initialization period in which the third switching element is turned on and a voltage in the source of the driving switching element is initialized, a sampling period in which the second switching element is turned on and the voltage in the source of the driving switching element is sampled, a programming period in which the fifth switching element is turned on and a data voltage is applied to the first node, a coupling period in which the fourth switching element is turned on and a reference voltage is applied to the first node, and an emission period in which all the second switching element and the driving switching element are turned on and make the organic light emitting diode emit light.

In the initialization period, the first switching element may be turned on and the reference voltage may be applied to the gate of the driving switching element, and the fourth switching element may be turned on and the reference voltage may be applied to the first node.

In the initialization period, the reference voltage applied to the first node and a reference voltage applied to the gate of the driving switching element may have different potentials.

A 1 horizontal period 1 H of the organic light emitting diode may include the sampling period and the programming period.

The sampling period and the programming period may be overlapped at least in part with each other.

During the 1 horizontal period 1 H, a voltage in the source of the driving switching element may be sampled and the data voltage may be applied to the first node at the same time.

In the coupling period, voltages in the gate of the driving switching element and the source of the driving switching element may be changed due to coupling between the first capacitor and the second capacitor.

In the pixel driving circuit, the first switching element and the fourth switching element may be connected to a same reference voltage line.

According to another aspect of the present disclosure, there is provided a method for driving an organic light emitting diode display device. The organic light emitting diode display device includes an organic light emitting diode disposed on each of a plurality of pixels, and a pixel driving circuit configured to drive the organic light emitting diode. The pixel driving circuit includes a driving switching element electrically connected to the organic light emitting diode and electrically connected between a high-potential voltage supply line and a low-potential voltage supply line. Further, the pixel driving circuit includes a first switching element connected to a gate of the driving switching element and a first scan signal line. Furthermore, the pixel driving circuit includes a second switching element connected to a drain of the driving switching element and a first emission control signal line. Moreover, the pixel driving circuit includes a first capacitor connected between the gate of the driving switching element and a first node. Further, the pixel driving circuit includes a third switching element connected to a source of the driving switching element, a second scan signal line, and an initialization voltage line. Furthermore, the pixel driving circuit includes a fourth switching element connected to the first node and a second emission control signal line. Moreover, the pixel driving circuit includes a fifth switching element connected to the first node, a third scan signal line, and a data voltage line. Further, the pixel driving circuit includes a second capacitor connected between the gate of the driving switching element and the source of the driving switching element. The method for driving the organic light emitting diode display device includes initializing a voltage in the source of the driving switching element by turning on the third switching element. Further, the method for driving the organic light emitting diode display device includes sampling the voltage in the source of the driving switching element by turning on the second switching element. Furthermore, the method for driving the organic light emitting diode display device includes writing and programming a data voltage on the first node by turning on the fifth switching element. Moreover, the method for driving the organic light emitting diode display device includes writing and coupling a reference voltage on the first node by turning on the fourth switching element. Further, the method for driving the organic light emitting diode display device includes making the organic light emitting diode emit light by turning on all the second switching element and the driving switching element. In the method for driving the organic light emitting diode display device according to another exemplary embodiment of the present disclosure, if the organic light emitting diode display device is driven at the same driving frequency, it can be driven with a higher resolution by reducing 1 horizontal period.

It will be apparent to those skilled in the art that various modifications and variations can be made in the organic light emitting diode display device and the method for driving the same of the present disclosure without departing from the technical idea or scope of the disclosure. Thus, it is intended that the present disclosure cover the modifications and variations of this disclosure provided they come within the scope of the appended claims and their equivalents.

What is claimed is:

1. An organic light emitting diode display device comprising:

an organic light emitting diode disposed on each of a plurality of pixels; and a pixel driving circuit configured to drive the organic light emitting diode, wherein the pixel driving circuit includes:

a driving switching element connected to the organic light emitting diode and electrically connected between a high-potential voltage supply line and a low-potential voltage supply line;

a first switching element connected to a gate of the driving switching element and a first scan signal line;

a second switching element connected to a drain of the driving switching element and a first emission control signal line;

a first capacitor connected between the gate of the driving switching element and a first node;

a third switching element connected to a source of the driving switching element, a second scan signal line and an initialization voltage line;

a fourth switching element connected to the first node and a second emission control signal line;

a fifth switching element connected to the first node, a third scan signal line and a data voltage line and a second capacitor connected between the gate of the driving switching element and the source of the driving switching element.

2. The organic light emitting diode display device according to claim 1, wherein the pixel driving circuit operates in a period divided into an initialization period in which the third switching element is turned on and a voltage in the source of the driving switching element is initialized, a sampling period in which the second switching element is turned on and the voltage in the source of the driving switching element is sampled, a programming period in which the fifth switching element is turned on and a data voltage is applied to the first node, a coupling period in which the fourth switching element is turned on and a reference voltage is applied to the first node, and an emission period in which all the second switching element and the driving switching element are turned on and make the organic light emitting diode emit light.

3. The organic light emitting diode display device according to claim 2, wherein in the initialization period, the first switching element is turned on and the reference voltage is applied to the gate of the driving switching element, and the fourth switching element is turned on and the reference voltage is applied to the first node.

4. The organic light emitting diode display device according to claim 2, wherein in the initialization period, the reference voltage applied to the first node and a reference voltage applied to the gate of the driving switching element have different potentials.

5. The organic light emitting diode display device according to claim 2, wherein a 1 horizontal period of the organic light emitting diode includes the sampling period and the programming period.

6. The organic light emitting diode display device according to claim 5, wherein the sampling period and the programming period are overlapped at least in part with each other.

7. The organic light emitting diode display device according to claim 5, wherein during the 1 horizontal period 1 H, a voltage in the source of the driving switching element is sampled and the data voltage is applied to the first node at the same time.

8. The organic light emitting diode display device according to claim 2, wherein in the coupling period, voltages in the gate of the driving switching element and the source of the driving switching element are changed due to coupling between the first capacitor and the second capacitor.

9. The organic light emitting diode display device according to claim 1, wherein in the pixel driving circuit, the first switching element and the fourth switching element are connected to a same reference voltage line.

10. A method for driving an organic light emitting diode display device, the method including an organic light emitting diode disposed on each of a plurality of pixels and a pixel driving circuit configured to drive the organic light emitting diode and including a driving switching element connected to the organic light emitting diode and electrically connected between a high-potential voltage supply line and a low-potential voltage supply line, a first switching element connected to a gate of the driving switching element and a first scan signal line, a second switching element connected to a drain of the driving switching element and a first emission control signal line, a first capacitor connected between the gate of the driving switching element and a first node, a third switching element connected to a source of the driving switching element, a second scan signal line, and an initialization voltage line, a fourth switching element connected to the first node and a second emission control signal line, a fifth switching element connected to the first node, a third scan signal line, and a data voltage line, and a second capacitor connected between the gate of the driving switching element and the source of the driving switching element, wherein the method for driving the organic light emitting diode display device comprises:

initializing a voltage in the source of the driving switching element by turning on the third switching element;

sampling the voltage in the source of the driving switching element by turning on the second switching element;

writing and programming a data voltage on the first node by turning on the fifth switching element;

writing and coupling a reference voltage on the first node by turning on the fourth switching element; and making the organic light emitting diode emit light by turning on all the second switching element and the driving switching element.

* * * * *